US006633808B1

(12) United States Patent
Schulz et al.

(10) Patent No.: US 6,633,808 B1
(45) Date of Patent: Oct. 14, 2003

(54) METHOD FOR TRANSMITTING TRAFFIC INFORMATION

(75) Inventors: Werner Schulz, Meerbusch (DE); Stefan Vieweg, Willich (DE); Christian Berwanger, Düsseldorf (DE); Ralf Kriesinger, Meerbusch (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/868,082

(22) PCT Filed: Nov. 29, 1999

(86) PCT No.: PCT/DE99/03879

§ 371 (c)(1),
(2), (4) Date: Oct. 9, 2001

(87) PCT Pub. No.: WO00/39773

PCT Pub. Date: Jul. 6, 2000

(30) Foreign Application Priority Data

Dec. 14, 1998 (DE) ..... 198 59 522
Aug. 27, 1999 (DE) ..... 199 41 648

(51) Int. Cl.[7] ..... G08G 1/09

(52) U.S. Cl. ..... 701/117; 701/118; 701/119; 340/905; 455/186.1

(58) Field of Search ..... 701/117, 118, 701/119; 340/905; 455/186.1

(56) References Cited

U.S. PATENT DOCUMENTS 4,380,821 A * 4/1983 Eckhardt ..... 455/524
5,020,143 A * 5/1991 Duckeck et al. ..... 455/186.1
5,173,691 A * 12/1992 Sumner ..... 340/905
5,465,088 A * 11/1995 Braegas ..... 340/905
5,848,354 A * 12/1998 Kamalski ..... 340/7.43
6,018,649 A * 1/2000 Ruhl ..... 455/186.1
6,173,165 B1 * 1/2001 Ruhl et al. ..... 455/186.1

* cited by examiner

*Primary Examiner*—Michael J. Zanelli
*Assistant Examiner*—Eric Gibson
(74) *Attorney, Agent, or Firm*—Cohen, Pontani, Lieberman & Pavane

(57) ABSTRACT

A digital card of a highway network is provided in the form of a traffic file in a traffic data control center and in a terminal. Sections of streets or lanes or groups of streets or lanes are each represented as a segment in the digital card. Data pertaining to a chain of segments which follow each other in a numerical sequence in the highway network are combined in the control center into traffic data packets. Each traffic data packet contains (a) an identifier symbol representing the identity of the segment at one end of the chain, (b) a numerical chain segment symbol representing the total number of segments in numerical sequence in the chain, and (c) at least one condition symbol representing the condition of at least one of the segments in the chain The traffic data packets are transmitted to the terminal, where they are decoded and route information is output to a terminal user.

19 Claims, 3 Drawing Sheets

| Segment | Following Segment Pointer | Output |
|---|---|---|
| 1 | 2 | "A8 Stuttgart" |
| 2 | 3 | "A8 Ulm" |
| 3 | 4 | "A8 München" |
| ... | ... | ... |

23, 27

Figure 2

METHOD FOR TRANSMITTING TRAFFIC INFORMATION

BACKGROUND OF THE INVENTION

1. Field of the Invention

2. Description of the Related Art

The expert in the field knows how to use RDS-TMC (Radio Data System-Traffic Message Channel) to transmit traffic information pertaining to a highway network from a traffic information control center to a terminal, where traffic information pertaining to each segment of the highway network is transmitted, and the traffic data, thus transmitted segment by segment, can be decoded in the terminal by the use of a coding/decoding table available there into a form suitable for presenting the data to the terminal user. This widespread method, however, is a very complicated way of transmitting traffic data in view of the quantity of data to be transmitted, especially so for the transmission of traffic data which remain unchanged over several segments of the highway network.

SUMMARY OF THE INVENTION

The task of the present invention is to create a method and devices which make it possible to transmit traffic data efficiently in the simplest and cheapest possible manner.

The invention makes it possible to transmit traffic data pertaining to several segments of a highway network, where the amount of data to be transmitted is relatively small. The traffic data to be transmitted include in particular the conditions of one or more segments of the highway network such as the travel time in this segment, the average speed there, the number of vehicles, the size of the traffic congestion, the presence of construction sites, drivers driving in the wrong direction, and weather conditions.

Transmission according to the invention is suitable both for conditions which remain the same over several segments (and thus suitable for traffic data to be transmitted which remain the same) and for traffic data pertaining to physically adjoining segments in which the conditions differ.

For the transmission of traffic data pertaining to a condition which is continuous over several physically adjoining segments of a highway network, it is possible to transmit, for example, the first or the last of these segments, the number of segments, and the condition. To transmit traffic data pertaining to different conditions (average speeds, etc.) in several physically adjoining segments of a highway network, it is advisable to transmit the first or the last of these successive segments, the number of segments, and the condition of each segment or of at least one segment (advisably the condition applicable to just one segment in each case) in the physical sequence in which the segments are arranged. In both cases, it is advantageous that there is no longer any need to identify each segment with the exception of the first or last segment, which means that the quantity of data to be transmitted is significantly reduced.

A segment table (advisably identical to that in the traffic data control center) is available in the terminal. In the segment table, it is advisable for the segments following each other in sequence in the highway network to carry successive segment numbers. A set of output instructions for a digital map database (e.g., for optical display or acoustic output) can be stored in memory in association with the segment numbers of the segments; for example, a chain of segments (which represent one or more lanes in one or more travel directions of an autobahn in the real highway network) can represent a lane in a two-dimensional display of the highway network. A segment can represent a section of an autobahn, so that, when the traffic data, including the segment and its condition, are transmitted, a test sequence for this segment (such as "Autobahn A57 between Düsseldorf and Cologne") and possibly also a text sequence for the condition (e.g., "congestion") can be found in the segment table stored in the terminal, and these texts can be generated acoustically.

The data are transmitted by radio, especially mobile radio broadcast (GMS-SMS-CB). News summary transmission is especially suitable. In digital mobile radio networks, broadcast transmission (cell broadcast) is possible.

BRIEF DESCRIPTION OF THE DRAWINGS

FIG. 2 shows a segment table provided in the terminal and in the data control center.

DETAILED DESCRIPTION OF THE PRESENTLY PREFERRED EMBODIMENTS

Figure 1:
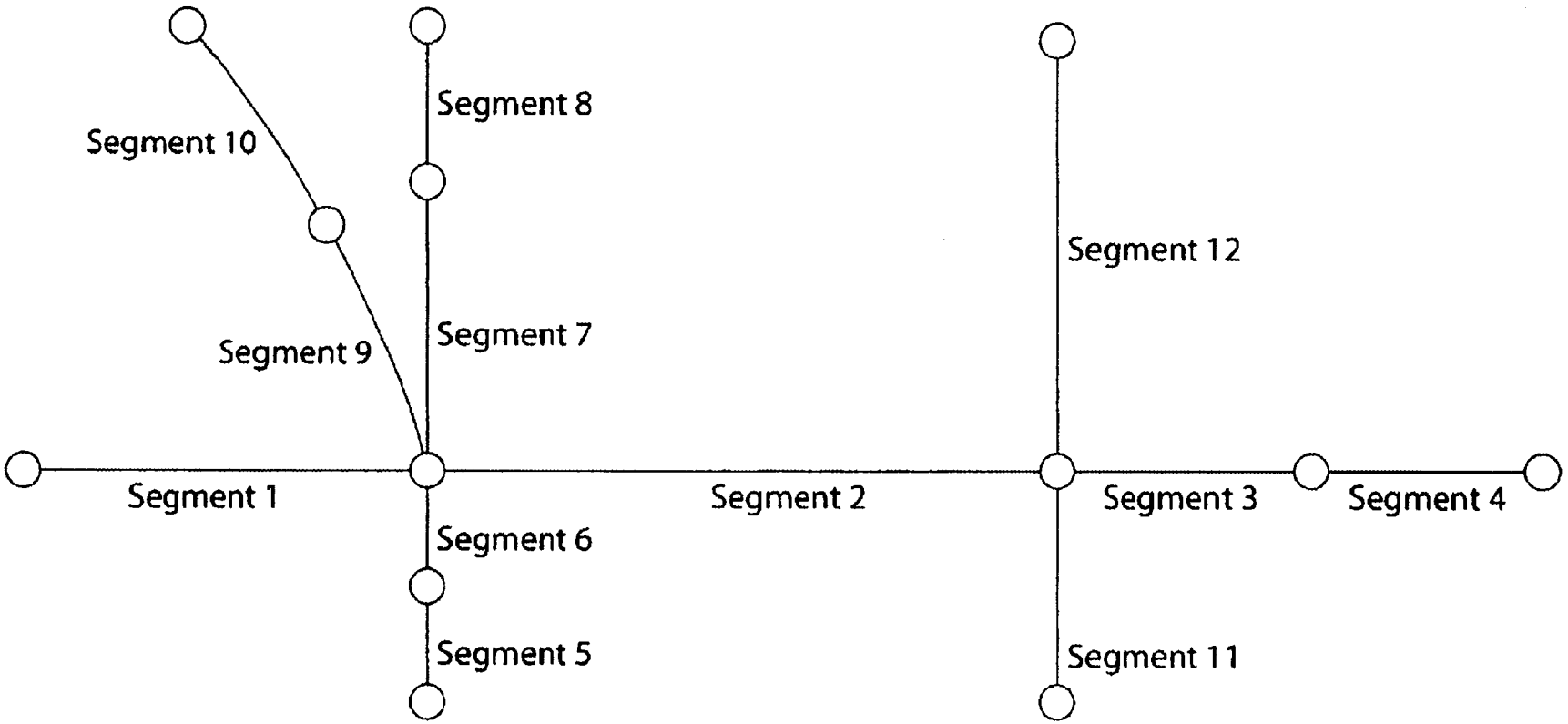
FIG. 1 shows part of a highway network with streets divided into several segments.

FIG. 1 shows part of a highway network with a street proceeding from left to right, consisting of segments 1–4 (the number of a segment being identical to its reference symbol); a street leading from the bottom to the top, consisting of segments 5, 6, 7, and 8; another street with segments 9, 10, etc., branching off from the intersection of the street consisting of segments 1–4 and the street consisting of segments 5–8; and a street consisting of segments 11, 12 leading from the bottom to the top.

So that traffic data pertaining to the segments of the streets of the traffic network, a portion of which is shown in the figure, can be transmitted as efficiently as possible from a traffic data control center to a terminal, the traffic data are coded in the control center according to the invention by a table and decoded by an identical table in the terminal, so that the information can be presented to the user (e.g., optically in a two-dimensional signal map database of the highway network or acoustically). When, for example, a low average speed is present in segments 1, 2, 3 of the street proceeding from left to right in FIG. 1, a segment identifier for one of the three segments and a condition code representing the condition of the segment can be transmitted, as is conventional in RDS-TMC. In this case, the transmission according to the invention consists of the identifier of segment 1 (e.g., a "1"), the number of segments 1–3 to which the transmitted traffic data refer (i.e., a "3"), and either a condition which applies to all the segments (1–3) included in the transmission or the condition of each segment in the order in which they occur (1–3). For this purpose, it is necessary that the numbering of the sequence of the segments be defined in the same way in the control and in the terminal. As illustrated in FIG. 1, this can be done by an ascending sequence of numbers proceeding along the street from left to right. This becomes problematic, however, at intersections, especially forks, such as on the left in FIG. 1.

Figure 3:
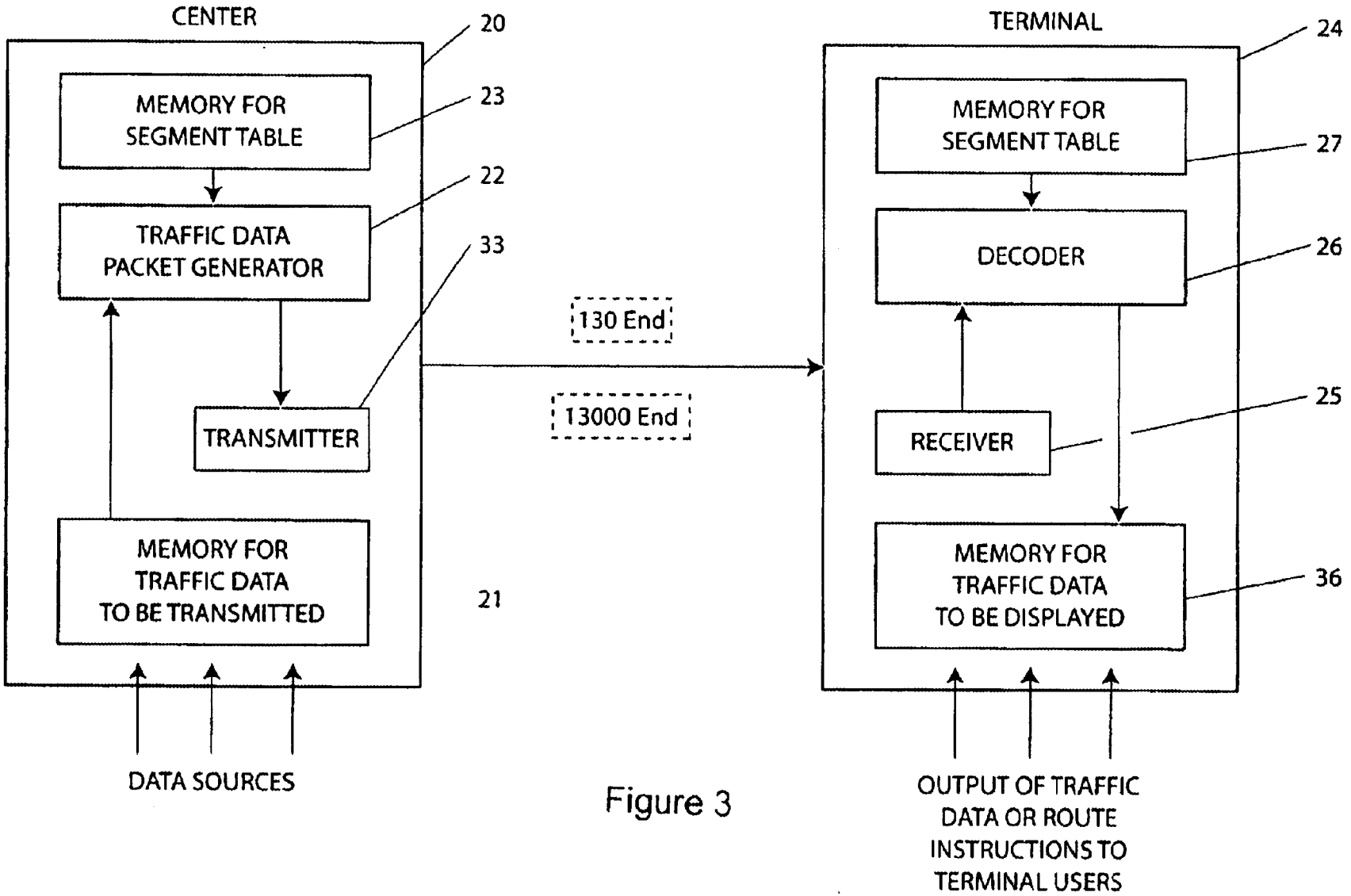
FIG. 3 shows the essential elements of the control center, of the terminal, and of the transmission as a functional block diagram.

For this reason, tables according to FIG. 2 and/or FIG. 3 are used for decoding in the terminal (and advisably in an identical manner in the traffic control center).

In FIG. 2, a pointer to the following segment, which is to be considered the one coming next in the travel direction, is provided for each segment to represent the order in which the segments are arranged; that is, the pointer of segment 1 points to segment 2 to indicate that it is the segment which comes next; the pointer of segment 2 points to segment 3 as the segment coming next; the pointer of segment 3 points to segment 4 as the segment coming next, etc. In addition to the pointer information representing the sequence of the segments, an output such as "A8-Stuttgart", etc., representing information for the terminal user, is also shown, which can be transmitted along with traffic data for the segment in question. The text information provided is especially suitable for acoustic output. For output on a digital map database, the proper reference to the digital map database must be provided (e.g., coordinates). When, for example, condition data (e.g., "congestion") concerning the segment chain 1, 2, 3, are transmitted to the terminal from the traffic data control center the transmission would consist of the segment 1, the number 3, and the condition datum "0", which would be decoded by the condition table as meaning "congestion".

FIG. 3 shows a functional block diagram of the elements of the control center and of the terminal as well as the transmission of data from the control center to the terminal. The traffic data control center 20 receives or generates the traffic data to be transmitted, which are stored in the memory unit 21. The traffic data can be based in particular on data from detectors permanently installed along the streets of the traffic network, on mobile detectors in vehicles traveling within the traffic network, and on other sources as well.

The traffic data 21 to be transmitted are coded according to the invention in the traffic data packet generator 22. For this purpose, a segment table 23 (e.g., like that shown in FIG. 2) is used. The traffic data 21 to be transmitted, pertaining to congestion in segment 1, congestion in segment 2, and a congestion in segment 3, for example, are therefore coded as "1, 3, 0, end" (where "1" stands for segment 1; "3" stands for three segments; "0" stands for an average speed of 0, meaning a congestion; and "end" is an end flag). The end flag is used here only for the sake of illustration. Other technical variants of such protocols for uniquely designating the end of a message are known to the expert. This coded information is passed on to the transmitter 33 for transmission. The transmitter 33 can be, for example, a mobile radio transmitter or access to a mobile radio transmitter. After transmission by radio, especially by mobile radio, the information is received at the terminal 24 by the receiver 25 and decoded by a decoding device 26. For this purpose, the decoding device uses a segment table 27 (which corresponds to the segment table 23). The decoded traffic data can then be presented to the user. They can also be stored (36). The traffic data can also be used in the terminal 24 in particular to calculate an optimum route, the goal being to arrive at optimum travel times or the least possible congestion, etc.

Instead of a status symbol ("0") applicable to all segments (1, 2, 3) or to a chain of segments, the condition of each segment (1, 2, 3) of the designated segment chain ("1 3") can also be stated separately ("0 0 0"). The distinction between these two options can be made at the terminal by means of a flag sent at the beginning of the transmission or by comparison of the number (a single 0 in the one case, three 0's in the other) of condition symbols preceding a (binary) "end" flag with the transmitted information ("3") symbolizing the number of chain segments involved. The invention can be realized as a program running in both the control center and in the terminal, but it is not limited to this form of embodiment and can also be designed as an electronic circuit.

What is claimed is:

1. A process for transmitting traffic data pertaining to a highway network from a traffic data control center to at least one terminal, said process comprising providing a digital map database of a highway network in the form of a traffic file in the traffic data control center and in the terminal, representing sections of streets, lanes, and groups of lanes as segments in said digital map database, combining data pertaining to a chain of said segments which follow each other in numerical sequence in said highway network, said data being combined in said control center into a traffic data packet containing (a) an identifier symbol representing the identity of the segment at one end of the chain, (b) a numerical chain segment symbol representing the total number of segments in numerical sequence in the chain, (c) at least one condition symbol, including a last condition symbol, representing the condition of at least one of said segments in said chain, and (d) a pointer for at least one of said segments, said pointer indicating which one of said segments follows each said at least one of said segments in a direction of travel; and transmitting said data packet from said traffic data control center to said at least one terminal.

2. A process for transmitting traffic data as in claim 1 wherein a condition symbol representing the condition of all segments in said chain is combined in said control center into said traffic data packet.

3. A process for transmitting traffic data as in claim 1 wherein a condition symbol for each segment in said chain is combined in said control center into said traffic data packet.

4. A process for transmitting traffic data as in claim 3 wherein said discretely quantized condition information is quantized in a maximum of ten stages.

5. A process for transmitting traffic data as in claim 4 wherein said discretely quantized condition information is quantized in a maximum of five stages.

6. A process for transmitting traffic data as in claim 1 further comprising transmitting a defined end symbol after transmitting the last condition symbol in said traffic data packet.

7. A process for transmitting traffic data as in claim 1 further comprising decoding said traffic data packet in said terminal, said decoding comprising determining the number of segments in said chain and indicating the segments which are designated with respect to condition data.

8. A process for transmitting traffic data as in claim 1 wherein said traffic data packet further comprises information indicating whether one condition symbol is being transmitted for all segments, or whether a different condition symbol is being transmitted for each segment.

9. A process for transmitting traffic data as in claim 1 wherein said numerical chain segment symbol is transmitted with one of a positive sign and a negative sign, wherein a negative sign indicates chain segments in a numerical sequence preceding the segment at one end of the chain, and a positive sign indicates chain segments in a numerical sequence following the segment at one end of the chain.

10. A process for transmitting traffic data as in claim 1 further comprising assigning a sequence designator for all traffic data packets which pertain to the same segments, and transmitting this designator along with each packet.

11. A process for transmitting traffic data as in claim 1 wherein said one of said segments which follows is stored in memory.

12. A process for transmitting traffic data as in claim 1 wherein said at least one condition symbol represents the condition of at least one of driving speed, travel time, a deviation of the driving speed from an expected value, a deviation of the travel time from an expected value, and a value based on one of said deviations.

13. A process for transmitting traffic data as in claim 1 wherein said at least one condition symbol represents at least one of the weather and the location of construction sites in a segment.

14. A process for transmitting traffic data as in claim 1 wherein said at least one condition symbol represents discretely quantized condition information.

15. A process for transmitting traffic data as in claim 1 wherein said data are transmitted by a radio data system.

16. A process for transmitting traffic data as in claim 1 wherein said data are transmitted by mobile radio broadcast.

17. A traffic data control center for transmitting traffic data pertaining to a highway network to at least one terminal, said control center comprising a memory with a digital map database of a highway network, in the form of a traffic file representing sections of streets, lanes, and groups of lanes as segments in said digital map database, a traffic data packet generator which combines data into a traffic data packet containing (a) an identifier symbol representing the identity of a segment at one end of a chain of sequentially numbered segments, (b) a numerical chain segment symbol representing the total number of segments in the chain, (c) at least one condition symbol representing the condition of at least one of said segments in said chain, and (d) a pointer for at least one of said segments, said pointer indicating which one of said segments follows each said at least one of said segments in a direction of travel; and a transmitter for the transmission of said traffic data packet to a terminal.

18. A terminal for receiving traffic data pertaining to a highway network transmitted from a traffic data control center, said terminal comprising a receiver for receiving traffic data packets from a traffic data control center, each said traffic data packet including (a) an identifier symbol representing the identity of a segment at one end of a chain of sequentially numbered segments, (b) a numerical chain segment symbol representing the total number of segments in the chain, (c) at least one condition symbol representing the condition of at least one of said segments in said chain, and d) a pointer for at least one of said segments, said pointer indicating which one of said segments follows each said at least one of said segments in a direction of travel;

a decoder for decoding received traffic data packets and preparing route information in a form which can be presented to a terminal user, and an output device for at least one of acoustic and optical output of said traffic route information to a terminal user.

19. A terminal as in claim 18 wherein said receiver is one of a mobile radio terminal and a connection to a mobile radio terminal.

* * * * *